US005706646A

United States Patent [19]

Wilde et al.

[11] Patent Number: 5,706,646

[45] Date of Patent: Jan. 13, 1998

[54] GAS TURBINE GAS DUCT ARRANGEMENT

[75] Inventors: Brendan J. Wilde, Rugby; Nicholas J. Kemsley, Nottingham; Peter W. Hill, Oadby, all of United Kingdom

[73] Assignee: European Gas Turbines Limited, United Kingdom

[21] Appl. No.: 647,807

[22] Filed: May 15, 1996

[30] Foreign Application Priority Data

May 18, 1995 [GB] United Kingdom ..... 9510069

[51] Int. Cl.[6] ..... F02C 3/00

[52] U.S. Cl. ..... 60/39.37; 60/39.32; 60/752

[58] Field of Search ..... 60/39.32, 39.37, 60/39.75, 752, 760

[56] References Cited

U.S. PATENT DOCUMENTS

| | | | |
|---|---|---|---|
| 3,657,882 | 4/1972 | Hugoson | 60/39.37 |
| 4,573,315 | 3/1986 | Stroem | 60/39.37 |
| 4,719,748 | 1/1988 | Davis, Jr. et al. | 60/39.37 |
| 5,265,412 | 11/1993 | Bagepalli et al. . | |
| 5,572,863 | 11/1996 | Wrightham et al. | 60/39.37 |

FOREIGN PATENT DOCUMENTS 2 123 136 A 1/1984 United Kingdom .

*Primary Examiner*—Charles G. Freay
*Attorney, Agent, or Firm*—Kirschstein et al.

[57] ABSTRACT

A transition duct arrangement for feeding combustion gases under pressure from a number (e.g. 4), of combustion chamber(s) arranged around the turbine into the annular passage containing the turbine blade structure. Each combustion chamber (5) has a transition duct section comprising a short length of the cylindrical combustion chamber walls (9 inner and 11 outer) developing into a section of annular duct (25 inner and 27 outer). The four transition duct sections make up a complete annulus but have to be clamped to the nozzle guide vane (85 FIG. 7 ) structure. The invention provides a means for combining the clamping and sealing of the transition sections efficiently and effectively.

17 Claims, 6 Drawing Sheets

GAS TURBINE GAS DUCT ARRANGEMENT

BACKGROUND OF THE INVENTION

This invention relates to a gas duct arrangement for a gas turbine, the gas duct arrangement supplying combustion gases from a plurality of combustion chambers to the turbine blading to drive the turbine. Such arrangements are known. One design of gas turbine employing such a gas duct arrangement is illustrated in the accompanying FIG. 1. Very briefly, this gas turbine comprises an air intake 1 to a succession of turbine compressor stages 3. Four combustion chambers 5 are arranged around the turbine shaft each being fed by fuel injectors 7. The compressed air from the compressor turbine enters the combustion chamber 5 mainly at the rear end around the fuel injectors 7 but also through the side walls of the chamber so that cooling air takes part in the combustion process. The combustion chamber is double walled, having an inner chamber wall 9 containing the combustion process and an outer sleeve 11 spaced from the inner wall by a small distance and having a multiplicity of small holes through which fine jets of air pass to impinge on the inner wall for cooling purposes.

The combustion gases under considerable pressure emerge from the combustion chambers in the region 13 to pass through the fixed and rotating blades of the compressor turbine 15 which drives the compressor 3 by way of a common shaft. The combustion gases are driven to the power turbine 17 and then to the exhaust outlet 19.

Clearly, the entry to the passage through the blades provided by an annular turbine blade structure, has to be coupled to the exit of the combustion chamber with as little leakage as possible. It is this feature with which the present invention is particularly concerned.

SUMMARY OF THE INVENTION

According to the present invention, in a gas duct arrangement for a gas turbine, for supplying combustion gases from a plurality of combustion chambers to an annular duct confronting an annular turbine blade structure, the arrangement comprises combustion chambers feeding the annular duct at positions around its circumference, each combustion chamber having a transition duct section comprising a portion of the combustion chamber integrated with a portion of the annular duct, and the transition sections being fixed to annular carrier means by clamp members which interconnect and locate the transition members relative to each other and carry seals to limit leakage of the working gas from the. interconnection.

Each combustion chamber may comprise an inner chamber wall containing the combustion gases and an outer sleeve having a multiplicity of apertures for impingement cooling purposes; the annular duct comprising inner and outer annular walls; each transition duct section comprising a section of the inner chamber wall integrated with a section of the inner annular wall and a section of the outer sleeve integrated with a section of the outer annular wall and wherein each clamp member carries seals sealing the clamp member to the inner walls of adjacent annular duct sections and seals sealing the clamp member to the outer annular walls of adjacent annular duct sections.

The annular carrier me, am may comprise inner and outer carrier members providing between them an annular aperture coinciding with the mouth of the annular duct, the inner carrier member carrying an annular seal arrangement for sealing the inner junction between the annular duct and the annular turbine blade structure and the outer carrier member carrying an annular seal arrangement for sealing the outer junction between the annular duct and the annular turbine blade structure.

The arrangement may further comprise inner and outer annular plate members mounted on the respective carrier members and locating the annular duct, plate members being fixed to the carrier members by fixing means common to that of the clamp member. The seal arrangement may be clamped between the respective carrier member and the respective annular plate member.

The outer annular wall may have inner and outer flanges fixed to the inner and outer carrier members respectively by fining means common to that of the clamp member.

Lug members on the inner chamber wall may be trapped between the inner and outer flanges of the outer annular wall and the respective inner and outer annular plate members. The lug members may be trapped in such manner as to permit expansion of the inner chamber wall in directions parallel to the plane of the annular duct.

The inner and outer annular plate members may have flanges along their confronting edges, these flanges providing abutment surfaces for the location of the lug members.

Each clamp member may be of saddle form and at each end of the saddle have a first surface which beds on to the respective carrier member through an aperture in the respective annular plate member so as to be located by the annular plate member; a second surface which beds on to the annular plate member and which has abutment edges for locating the adjacent flanges of the outer annular wall in a circumferential direction; and two third surfaces which bed on to the adjacent flanges of the outer annular wall.

Each clamp member may incorporate a heat shield confronting the gap between sections of the inner annular wall.

BRIEF DESCRIPTION OF THE DRAWINGS

One embodiment of gas duct arrangement in accordance with the invention will now be described, by way of example only, with reference to the accompanying drawings, of which.

DETAILED DESCRIPTION OF THE EMBODIMENT OF THE INVENTION

Figure 1:
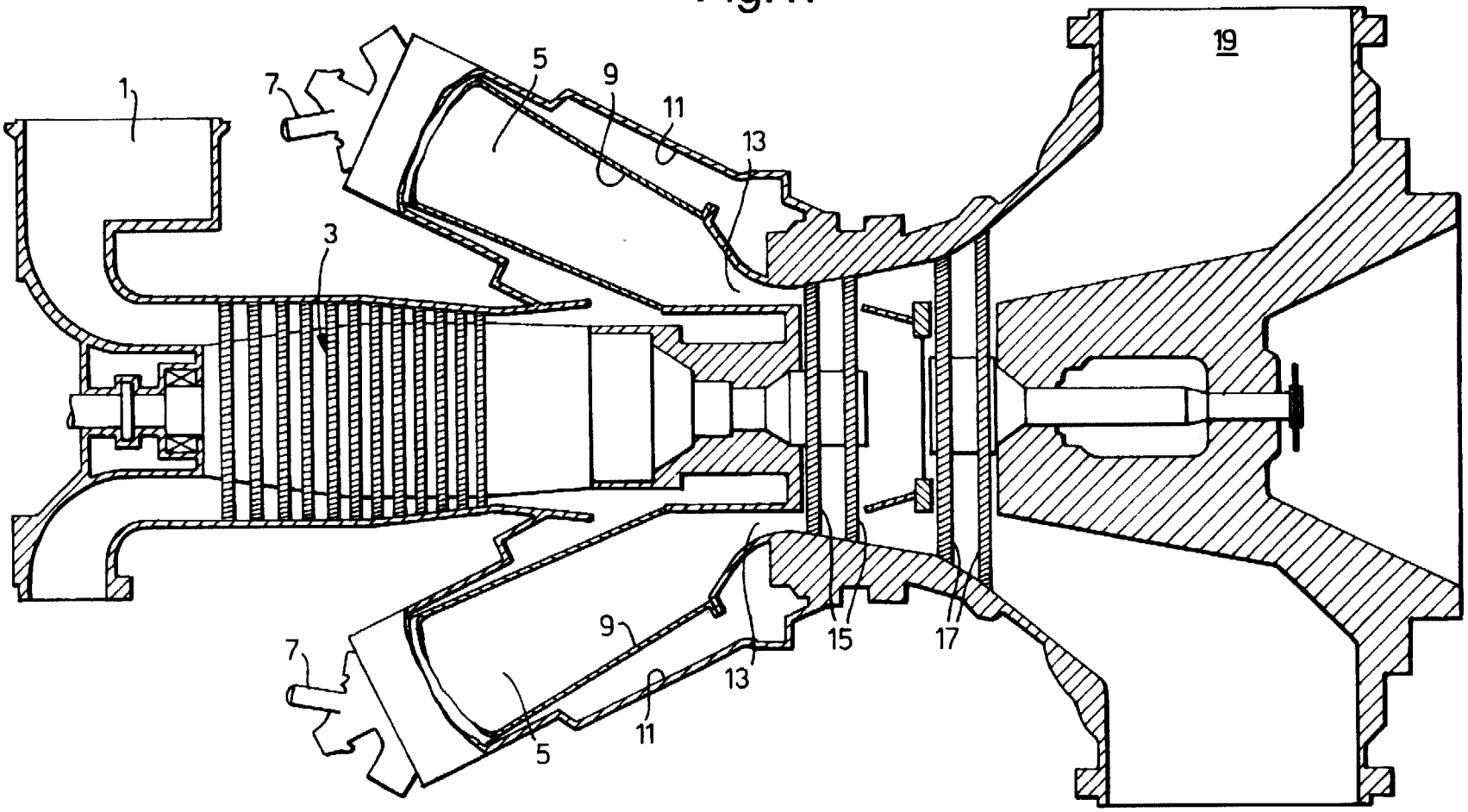
FIG. 1 is a section through a typical gas turbine, suitable for application of the invention.

Referring to the drawings generally, there are four combustion chambers 5 in the particular turbine in question and four associated transition duct sections. The transition duct section comprises an outlet portion 21 of the combustion chamber and a section 23 of the annular duct which supplies gas to the turbine blade structure (See FIG. 2 particularly).

Figure 2:
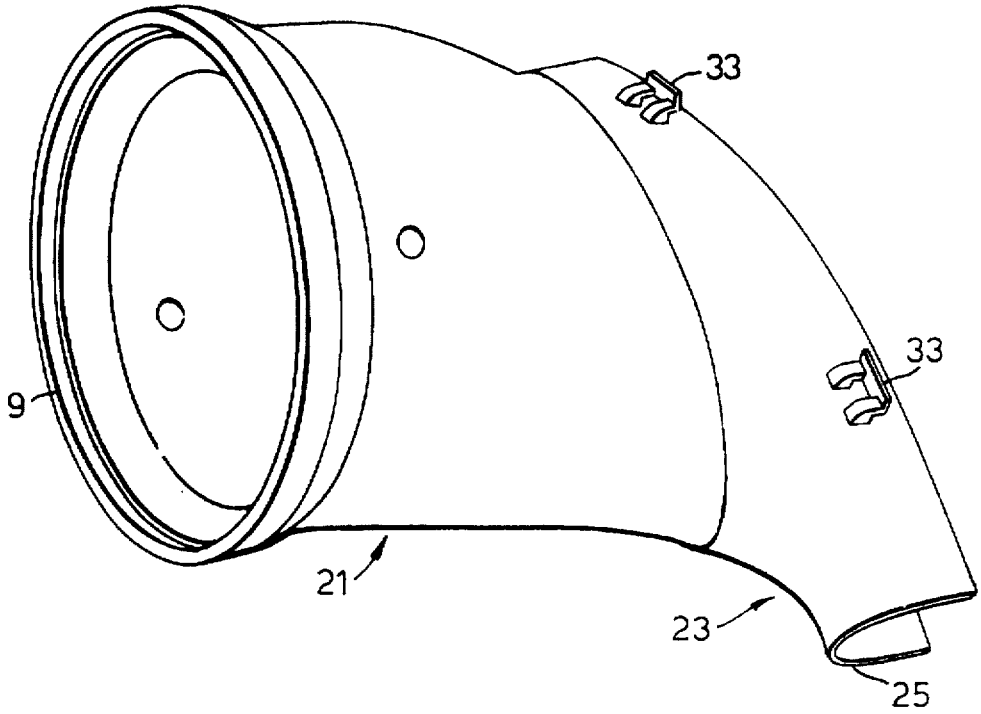
FIG. 2 is a perspective view of a transition duct section in which the outlet of a combustion chamber is integrated with a section of an annular duct.
Figure 5:
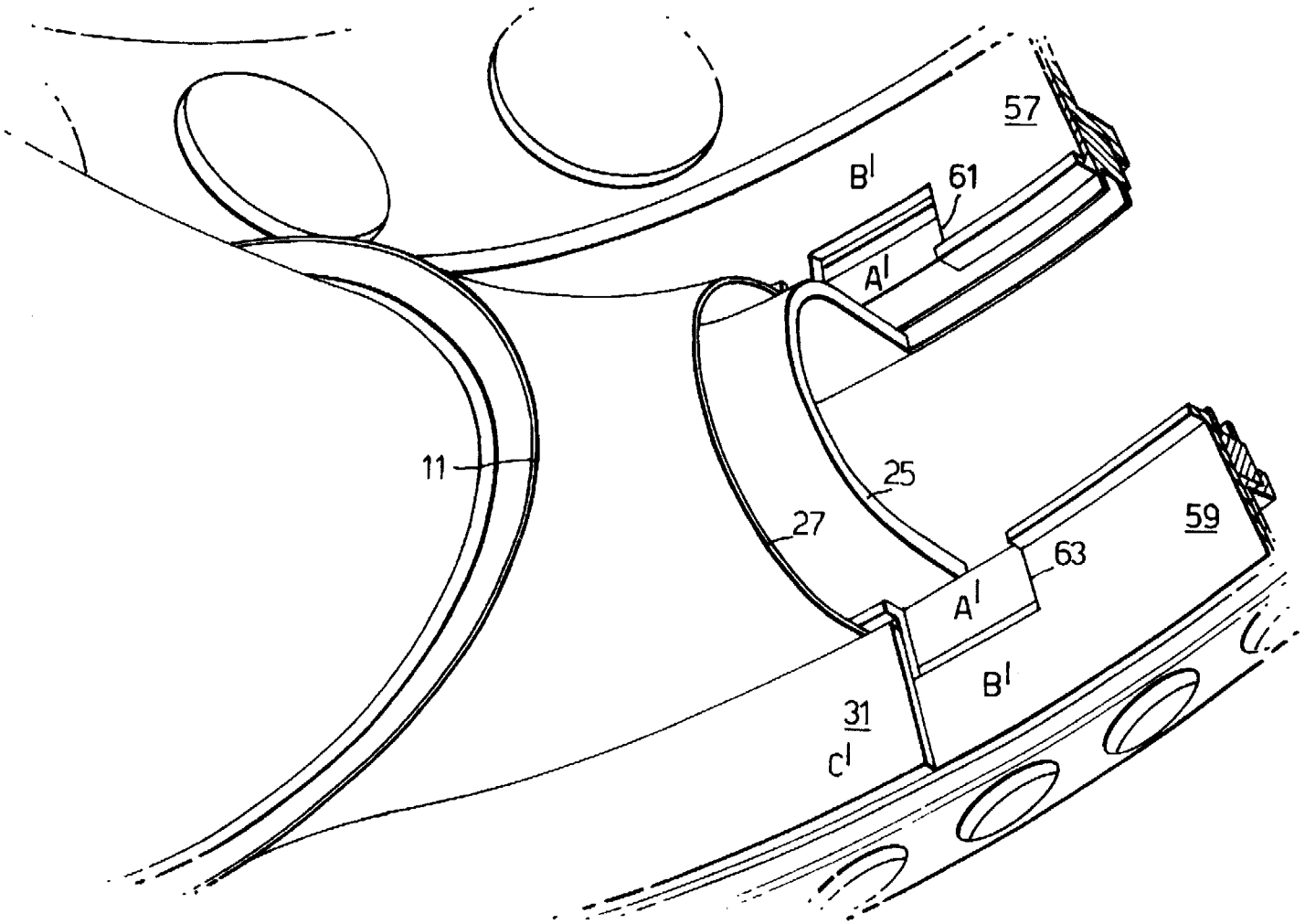
FIG. 5 is a detail of the transition duct section showing the relation of the transition duct end to the supporting carrier tings in the absence of the adjacent transition duct section and a clamp member over the junction.

The transition duct is double walled, continuing the design of the combustion chamber itself although only the inner chamber wall 9 is shown in FIG. 2, this being integrated with an inner wall 25 of the annular duct. The outer sleeve 11 of the transition duct is integrated with an outer wall 27 of the annular duct as shown in FIG. 5.

Figure 7:
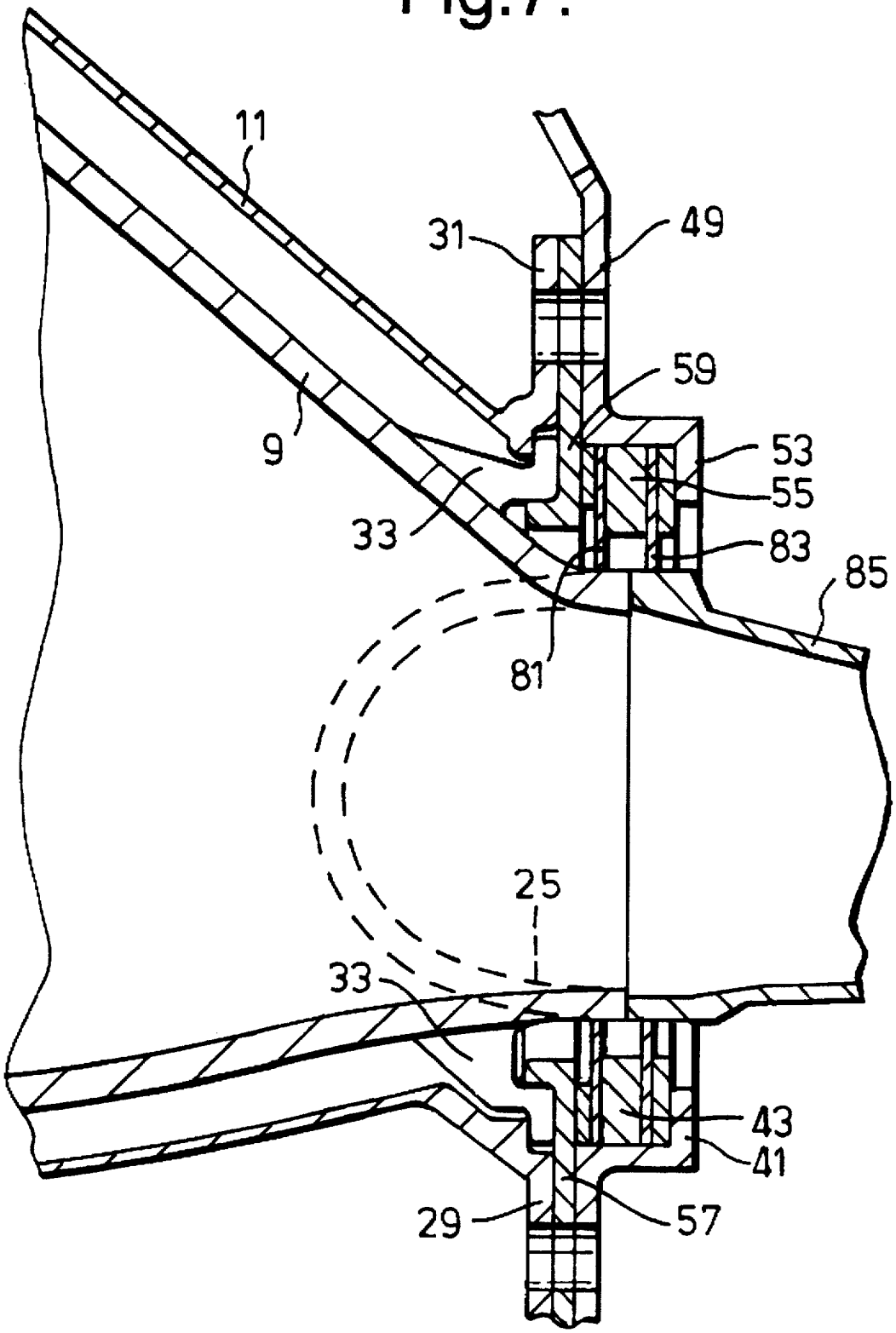
FIG. 7 is a diagrammatic section in an axial plane showing the attachment of the transition duct to the carrier rings.

The outer annular duct 27, i.e. the continuation of the sleeve 11, has inner and outer flanges 29 and 31 (shown in FIGS. 4, 5 and 7) by means of which the transition duct is bolted to carrier rings to be described. The inner wall 9 of the transition duct is supported by lugs 33 (FIGS. 2 and 7) which engage the outer sleeve flanges, as shown in FIG. 7.

Figure 3:
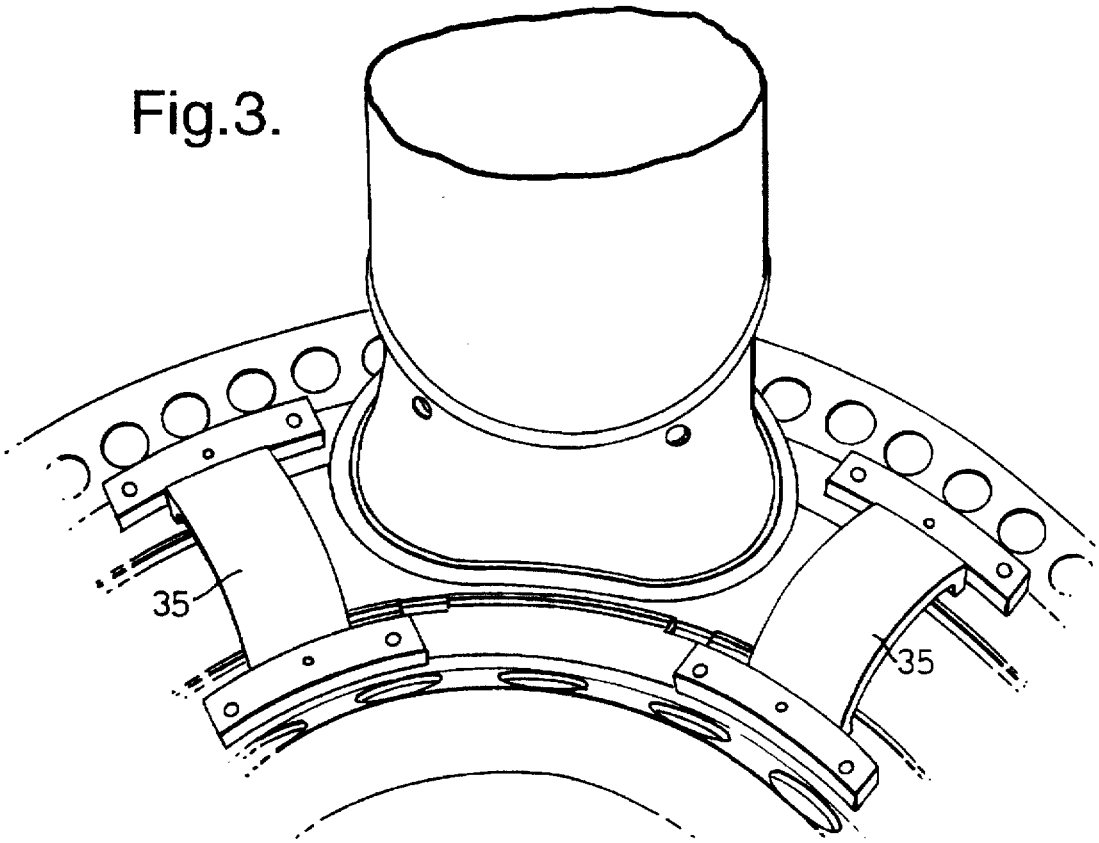
FIG. 3 is an axial perspective view of the transition duct section fitted to inner and outer annular carrier rings.

FIG. 3 shows a view along the turbine axis with one transition duct fixed in place by clamp members 35. The main support for the transition ducts is provided by two carrier tings which lie one within and one outside the annular duct. These carrier rings 37 and 47 are shown more clearly in FIG. 4. The inner one, 37, has a platform area 39 to which the transition ducts are bolted. A step formation 41 extending radially outwards from the platform accommodates an annular brash seal assembly 43 to be described. Inwardly from the platform area 39, the inner carrier ring 37 extends upstream in a skirt 45 thus providing considerable strength and rigidity to the carrier ring.

The outer carrier ring 47 has a similar platform 49 to which the outer flange 31 of the annular duct is bolted. Extending outwards from the,platform 49 is a skirt 51, again giving strength and rigidity. Extending inwardly is a step formation 53 accommodating an annular brush seal assembly 55, complementary to that, 43, on the inner carrier ring 37.

Although the flanges 29 and 31 of the annular duct outer wall are bolted to the carrier ring platforms 39 and 49, this fixing is by way of an intermediate clamp plate 57 or 59. These clamp plates (FIG. 4 and 5) are continuous but for cut-outs 61 and 63, which coincide with the junctions between adjacent sections of the annular duct.

Figure 4:
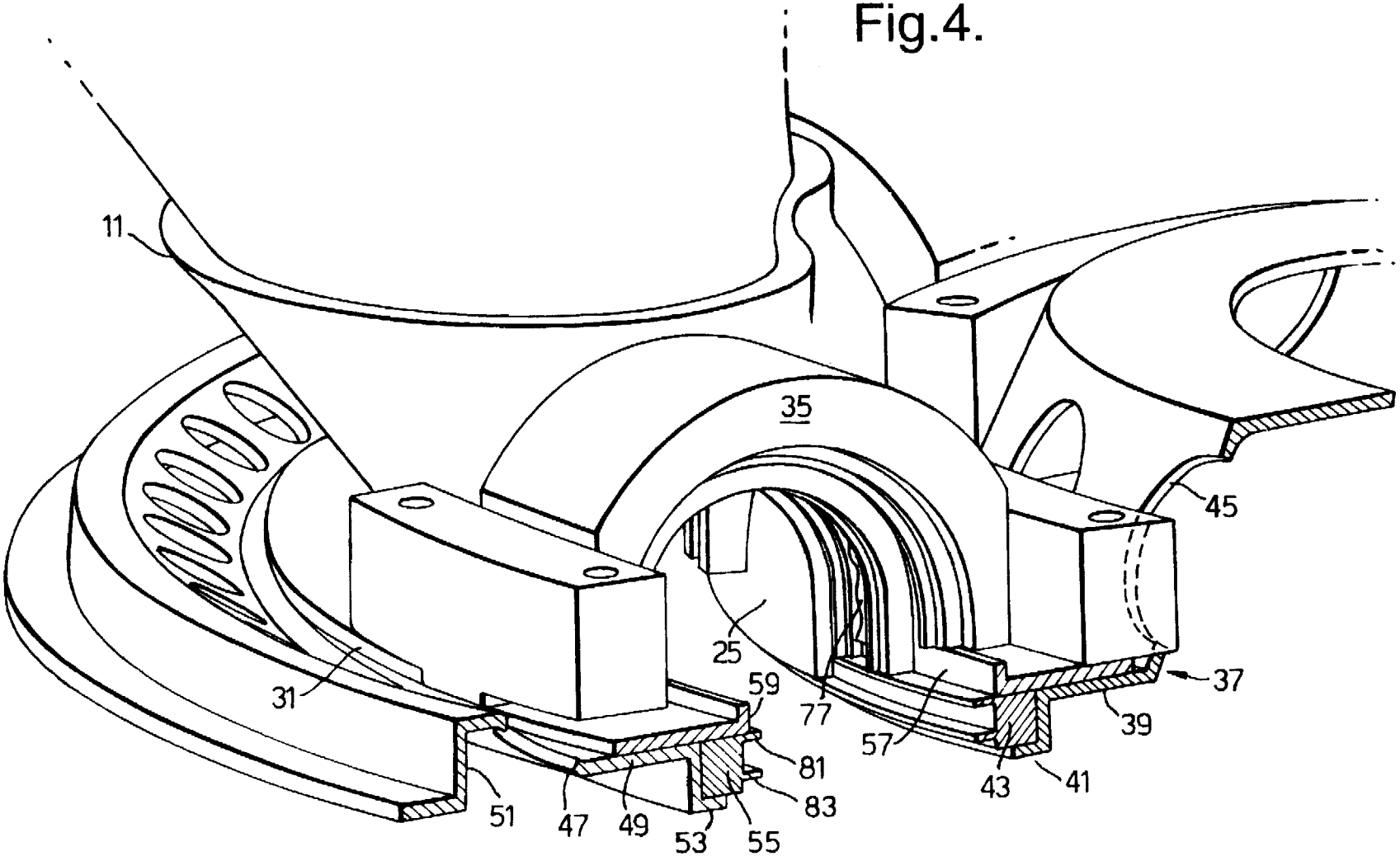
FIG. 4 is a perspective view of the transition duct section of FIG. 3 in a direction looking into the annular duct.
Figure 6:
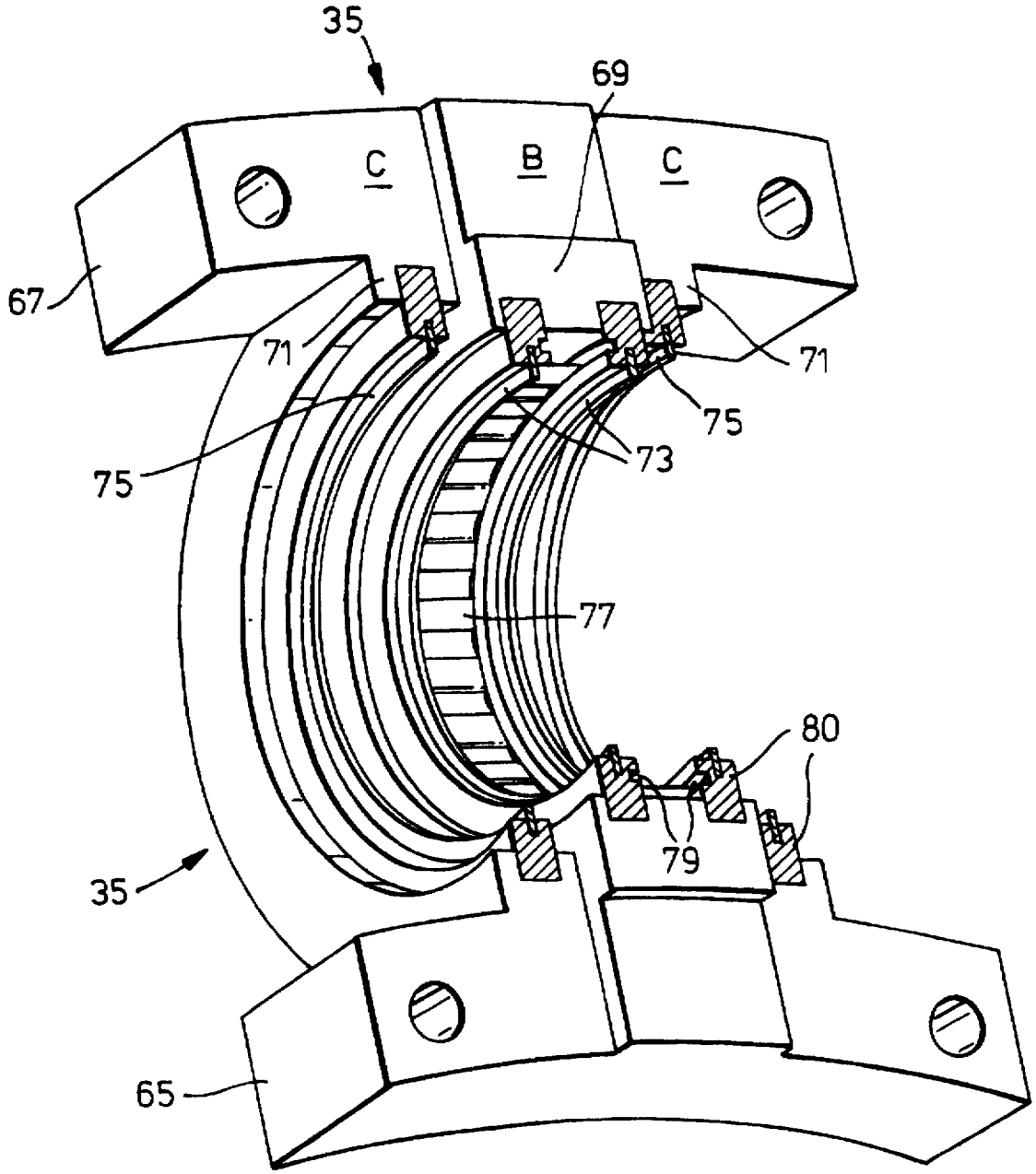
FIG. 6 is a perspective view of such a clamp member.

Referring now to FIG. 6, this shows the clamp member 35 in detail, ready for assembly to the annular duct of FIG. 5, to produce the assembly of FIG. 4. The clamp member is of broadly saddle form with circumferential blocks 65 and 67 at each end. Each of the blocks 65, 67 has three surface levels designated A, B and C. The 'deepest' surface, A, beds directly on to the platform surface of the carrier ring (at A') through the associated cut-out 61 or 63 in the clamp plate 57 or 59. The second surface, B, beds on to the clamp plate 57, 59 (at B'), and the third surface(s), C, bed on to the flanges 29 and 31 of the transition duct (at C'). It will be noted, of course, that one of the two adjacent transition ducts is not in position in FIG. 5 so as to show the arrangement more clearly.

It will be apparent from the above that the various components are mutually located and locked in position. The rotational position of the clamp plates 57 and 59 determine the position of the clamp members 35 by means of the surfaces 'A' engaging the cut-outs 61 and 63. The clamp members 35 determine the rotational position of the transition ducts by means of engagement between the circumferential ends of the flanges 29 and 31 and the shoulder (FIG. 6) formed by surfaces 'A' and 'B' upstanding from 'C'.

A further locating mechanism is provided by the bolt holes through the various components, flanges 29, 31, clamp plates 57, 59, clamp members 35 and the carrier inner and outer rings 37 and 47.

Since the rotational position of the combustion chambers 5 around the shaft is the determining factor, the flanges 29 and 31 will determine the position of the clamp members 35, hence the clamp plates 57 and 59, and the carrier rings 37 and 47.

Referring now to the sealing aspect of the duct arrangement, it is required that the junction between adjacent sections of the annular duct be sealed and also that the junction between the annular duct and the annular turbine blade structure be sealed. Referring to FIG. 6, this shows the provision for the former requirement. Brush seals are located in grooves in inner and outer surfaces 69, 71 of the clamp member. Each seal comprising bristle support 80 and bristle pack (73 inner, 75 outer). The inner brushes 73 engage respective ends of adjacent inner annular duct sections 25 (FIG. 5), and the outer brushes 75 engage the ends of adjacent outer sections 27. It will be seen that the pair of brushes engaging the same end of an annular duct section close off the space between the inner and outer walls and thus seal the outer wall to the inner wall. The inner duct is then continuous but the space between inner and outer walls extends from junction to junction. Any leakage through the gap between the adjacent ends of the inner walls will subject the wall of the clamp member 35 to considerable heating. Protection is provided by a removable flexible strip of metal 77 which is supported in grooves 79 in the sides of the brush holders. The protective strip is corrugated and resilient so as to maintain its position in the grooves.

If it were required to make the inter-wall space continuous around the annular duct, holes could be provided through the block having surfaces A so as to by-pass the seals 73.

Having sealed the transition duct sections together to produce a continuous annular duct, it remains to seal the annular duct to the turbine blade structure, i.e. the entrance to the turbine stages 15 (FIG. 1). FIG. 4 shows brush holders 43 and 55 clamped between the step 41, 53 on the carrier rings 37, 47 and the respective clamp plates 57, 59. Each brush holder is fitted with two brushes, an upstream brush 81 which engages the outside of the inner wall 25 of the annular duct, and a downstream brush 83 which engages the outside of an annular duct 85 (FIG. 7) which forms the inlet to the gas passage to turbine stages 15 and is part of the turbine blade structure. The leakage between the annular duct formed by the assembled transition duct sections and the turbine blade structure is thus very largely sealed.

The invention therefore provides, in the above described embodiment, a means for mounting, interlocking and sealing the combustion gas duct of a gas turbine in a particularly effective and relatively simple manner.

We claim:

1. A gas duct arrangement for a gas turbine, the gas duct arrangement being adapted to supply combustion gases from a plurality of combustion chambers to an annular duct confronting an annular turbine blade structure, the combustion chambers feeding the annular duct at positions around its circumference, and each combustion chamber having a transition duct section comprising a portion of the combustion chamber integrated with a portion of the annular duct, wherein the transition sections are fixed to annular carrier means by clamp members which interconnect and locate the transition members relative to each other and carry seals to limit leakage of the working gas from the interconnection.

2. A gas duct arrangement according to claim 1 wherein each said combustion chamber comprises an inner chamber wall containing the combustion gases and an outer sleeve having a multiplicity of apertures for impingement cooling purposes; said annular duct comprises inner and outer annular walls; each said transition duct section comprises a section of said inner chamber wall integrated with a section of the inner annular wall and a section of said outer sleeve integrated with a section of said outer annular wall, and wherein each said clamp member carries seals sealing the clamp member to the inner walls of adjacent annular duct sections and seals sealing the clamp member to the outer annular walls of adjacent annular duct sections.

3. A gas duct arrangement according to claim 2, wherein the seals sealing the clamp member to the inner and outer annular walls effectively seal the outer annular wall to the inner annular wall at each clamp member location.

4. A gas duct arrangement according to claim 1, wherein said annular carrier means comprises inner and outer carrier members providing between them an annular aperture coinciding with the mouth of said annular duct, the inner carrier member carrying an annular seal arrangement for sealing the inner junction between said annular duct and said annular turbine blade structure and the outer carrier member carrying an annular seal arrangement for sealing the outer junction between said annular duct and said annular turbine blade structure.

5. A gas duct arrangement according to claim 4, further comprising inner and outer annular plate members mounted on the respective carrier members and locating the annular duct, said plate members being fixed to the carrier members by fixing means common to that of the clamp member.

6. A gas duct arrangement according to claim 5, wherein said seal arrangement is clamped between the respective carrier member and the respective annular plate member.

7. A gas duct arrangement according to claim 2, wherein said annular carrier means comprises inner and outer carrier members providing between them an annular aperture coinciding with the mouth of said annular duct, the inner carrier member carrying an annular seal arrangement for sealing the inner junction between said annular duct and said annular turbine blade structure and the outer carrier member carrying an annular seal arrangement for sealing the outer junction between said annular duct and said annular turbine blade structure, each said annular seal arrangement comprising a brush holder fitted with two spaced apart brushes in upstream/downstream relationship, the downstream brush engaging the annular turbine blade structure and providing a seal therewith and the upstream brush engaging said inner annular duct wall and providing a seal therewith.

8. A gas duct arrangement according to claim 2, wherein said annular carrier means comprises inner and outer carrier members providing between them an annular aperture coinciding with the mouth of said annular duct, the inner carrier member carrying an annular seal arrangement for sealing the inner junction between said annular duct and said annular turbine blade structure and the outer carrier member carrying an annular seal arrangement for sealing the outer junction between said annular duct and said annular turbine blade structure, the gas duct arrangement further comprising inner and outer annular plate members mounted on the respective carrier members and locating the annular duct, said plate members being fixed to the carrier members by fixing means common to that of the clamp member, said outer annular wall having inner and outer flanges fixed to said inner and outer carrier members respectively by fixing means common to that of the clamp member.

9. A gas duct arrangement according to claim 8, wherein lug members are provided on said inner chamber wall, said lug members being trapped between the inner and outer flanges of said outer annular wall and the respective inner and outer annular plate members.

10. A gas duct arrangement according to claim 9, wherein said lug members are trapped in such manner as to permit expansion of the inner chamber wall in directions parallel to the plane of the annular duct.

11. A gas duct arrangement according to claim 9, wherein said inner and outer annular plate members have flanges along their confronting edges, these flanges providing abutment surfaces for the location of the lug members.

12. A gas duct arrangement according to claim 8, wherein each clamp member is of saddle form and at each end of the saddle has a first surface which beds on to the respective carrier member through an aperture in the respective annular plate member so as to be located by the said annular plate member; a second surface which beds on to the said annular plate member and which has abutment edges for locating the adjacent flanges of said outer annular wall in a circumferential direction; and two third surfaces which bed on to said adjacent flanges of said outer annular wall.

13. A gas duct arrangement according to claim 1, wherein said seals are wire brush seals.

14. A gas duct arrangement according to claim 4, wherein each said annular seal arrangement is a wire brush seal.

15. A gas duct arrangement according to claim 1, wherein each said clamp member incorporates a heat shield confronting the gap between sections of said inner annular wall.

16. A gas duct arrangement according to claim 15, wherein said heat shield is a removable strip of metal held in two slots.

17. A gas duct arrangement according to claim 15, wherein said heat shield is a coating of ceramic material.

* * * * *